US006658774B1

(12) United States Patent
Munter et al.

(10) Patent No.: US 6,658,774 B1
(45) Date of Patent: Dec. 9, 2003

(54) ILLUMINATED IDENTIFICATION SYSTEM

(76) Inventors: Keith F. Munter, 1832 S. Cypress St., Sioux City, IA (US) 51106; Matthew L. Kempers, 2327 W. 4th St., Sioux City, IA (US) 51103; Earl F. Munter, 2315 S. Cedar St., Sioux City, IA (US) 51106

( * ) Notice: Subject to any disclaimer, the term of this patent is extended or adjusted under 35 U.S.C. 154(b) by 0 days.

(21) Appl. No.: 10/323,424

(22) Filed: Dec. 18, 2002

(51) Int. Cl.[7] ..... G09S 13/04

(52) U.S. Cl. ..... 40/574; 40/575; 40/576; 40/580; 362/235; 362/812

(58) Field of Search ..... 40/564, 574, 575, 40/576, 580; 362/235, 812

(56) References Cited

U.S. PATENT DOCUMENTS 1,761,868 A * 6/1930 Burke ..... 40/580
3,864,861 A * 2/1975 Hill, Jr. ..... 40/576
4,201,005 A * 5/1980 Hunt ..... 40/570
4,686,505 A * 8/1987 Vanderburg ..... 40/564
5,435,087 A * 7/1995 Karkar et al. ..... 40/575
5,778,579 A * 7/1998 Yuen ..... 40/564
5,911,524 A * 6/1999 Wilton ..... 40/574
5,934,798 A * 8/1999 Roller et al. ..... 362/235
5,953,842 A * 9/1999 Bodell ..... 40/570
6,367,180 B2 * 4/2002 Weiss et al. ..... 40/580

* cited by examiner

*Primary Examiner*—Gary Hoge

(57) ABSTRACT

An illuminated identification system for providing efficient identification of a building structure in various light conditions. The illuminated identification system includes a housing unit, one or more light bulbs positioned within the housing unit, an identifying plate containing an indicia, a transparent cover plate, and a photocell switch unit electrically connected to the light bulbs. The light bulbs illuminate the interior of the housing unit when the photocell switch unit detects reduced outdoor lighting. The indicia may be formed within the identifying plate by coloring or by cutting out one or more slots forming the indicia.

10 Claims, 10 Drawing Sheets

ILLUMINATED IDENTIFICATION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to address signs and more specifically it relates to an illuminated identification system for providing efficient identification of a building structure in various light conditions.

2. Description of the Related Art

Address signs have been in use for years. An address sign displays the street address of a building structure and are typically viewable from a significant distance. Address signs may be comprised of raised or engraved numbers/letters attached to the building structure. Address signs are typically attached to the front of a building structure thereby identifying the building for visitors and emergency personnel.

The main problem with conventional address signs is that they are difficult to view during darkness. Another problem with conventional address signs is that they often times require a building owner to maintain outside lighting which can be costly and provide other undesirable effects for a building owner.

While these devices may be suitable for the particular purpose to which they address, they are not as suitable for providing efficient identification of a building structure in various light conditions. Conventional address signs do not provide adequate identification of a building structure during periods of darkness.

In these respects, the illuminated identification system according to the present invention substantially departs from the conventional concepts and designs of the prior art, and in so doing provides an apparatus primarily developed for the purpose of providing efficient identification of a building structure in various light conditions.

BRIEF SUMMARY OF THE INVENTION

In view of the foregoing disadvantages inherent in the known types of address signs now present in the prior art, the present invention provides a new illuminated identification system construction wherein the same can be utilized for providing efficient identification of a building structure in various light conditions.

The general purpose of the present invention, which will be described subsequently in greater detail, is to provide a new illuminated identification system that has many of the advantages of the address signs mentioned heretofore and many novel features that result in a new illuminated identification system which is not anticipated, rendered obvious, suggested, or even implied by any of the prior art address signs, either alone or in any combination thereof.

To attain this, the present invention generally comprises a housing unit, one or more light bulbs positioned within the housing unit, an identifying plate containing an indicia, a transparent cover plate, and a photocell switch unit electrically connected to the light bulbs. The light bulbs illuminate the interior of the housing unit when the photocell switch unit detects reduced outdoor lighting. The indicia may be formed within the identifying plate by coloring or by cutting out one or more slots forming the indicia.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an illuminated identification system that will overcome the shortcomings of the prior art devices.

A second object is to provide an illuminated identification system for providing efficient identification of a building structure in various light conditions.

Another object is to provide an illuminated identification system that may be easily viewed from a significant distance in various lighting conditions.

An additional object is to provide an illuminated identification system that may be utilized upon new or existing building structures.

A further object is to provide an illuminated identification system that reduces the energy costs of providing a viewable address sign at nighttime.

Another object is to provide an illuminated identification system that is adjustable and modifiable.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
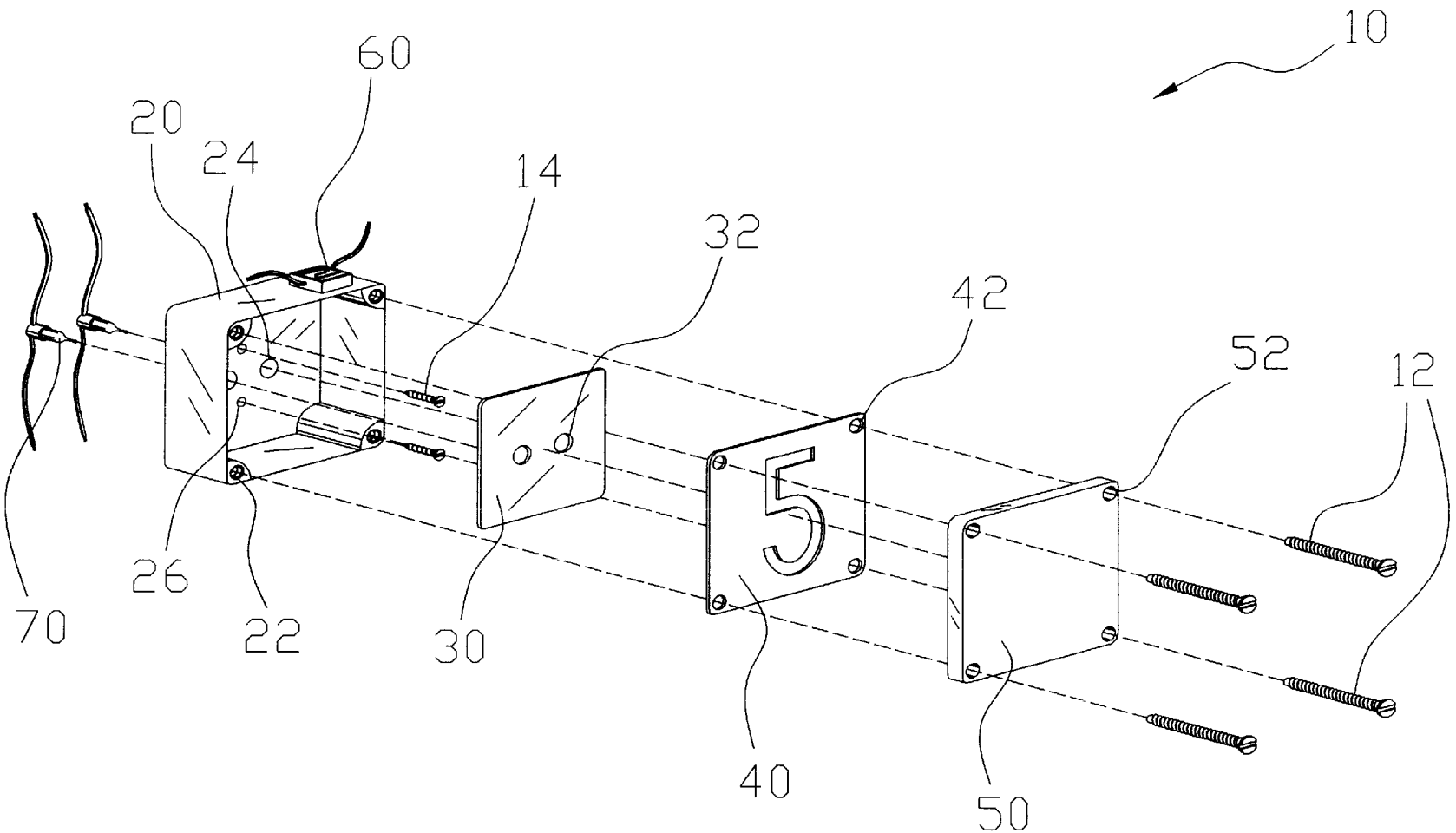
FIG. 1 is an exploded upper perspective view of the present invention.

Turning now descriptively to the drawings, in which similar reference characters denote similar elements throughout the several views, FIGS. 1 through 10 illustrate an illuminated identification system 10, which comprises a housing unit 20, one or more light bulbs 70 positioned within the housing unit 20, an identifying plate 40 containing an indicia, a transparent cover plate 50, and a photocell switch unit 60 electrically connected to the light bulbs 70. The light bulbs 70 illuminate the interior of the housing unit 20 when the photocell switch unit 60 detects reduced outdoor lighting. The indicia may be formed within the identifying plate 40 by coloring or by cutting out one or more slots forming the indicia.

FIG. 1 illustrate the housing unit 20 having an interior cavity, a rear wall and a plurality of sidewalls extending orthogonally from the rear wall. It can be appreciated that the housing unit 20 may have various other shapes and sizes though not illustrated in the drawings. One or more housing units 20 may be connected to one another either vertically or horizontally to form the desired address information.

FIG. 1 further illustrates that the housing unit 20 includes a plurality of threaded apertures 22, one or more rear light apertures 24, and one or more rear mounting apertures 26. The mounting apertures 26 receive one or more second fasteners 14 for securing to a wall, post, column or other structure. One or more first fasteners 12 are used to secure the identifying plate 40 and the cover plate 50 to the front opening of the housing unit 20 as best illustrated in FIG. 1 of the drawings.

Figure 2:
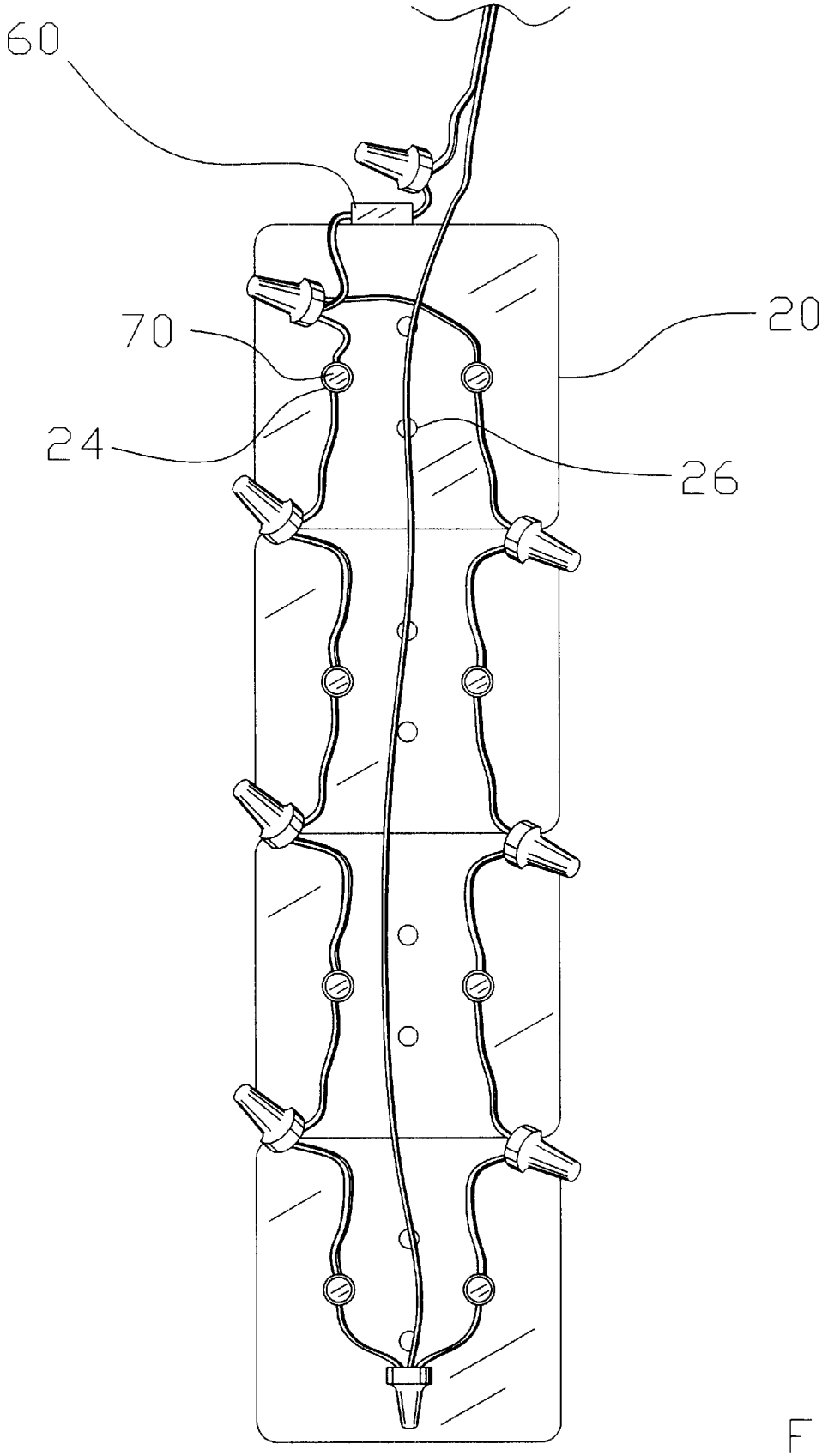
FIG. 2 is a rear view of the present invention with a plurality of housing units stacked together.
Figure 3:
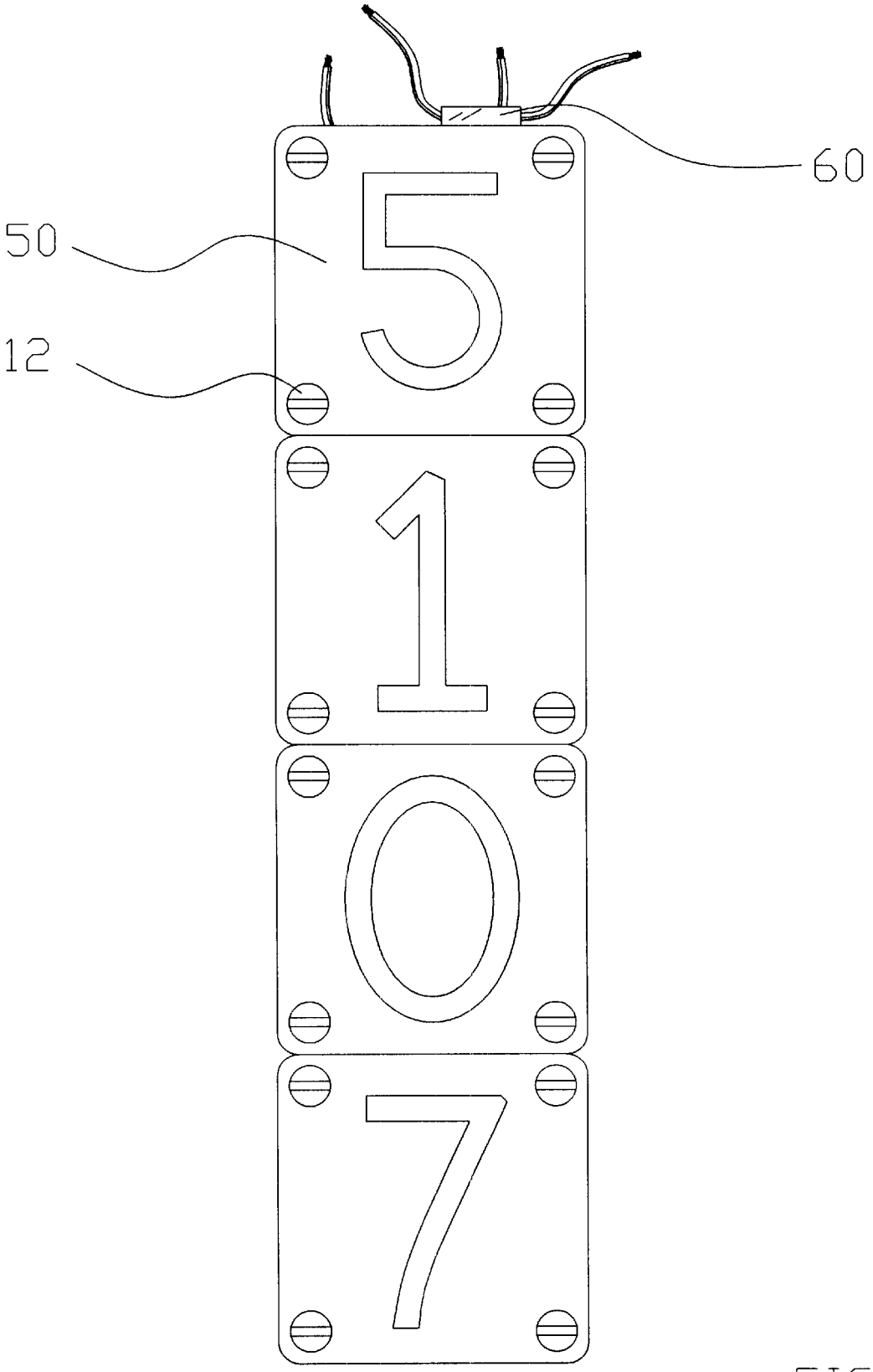
FIG. 3 is a front view of the present invention with a plurality of housing units stacked together.
Figure 4:
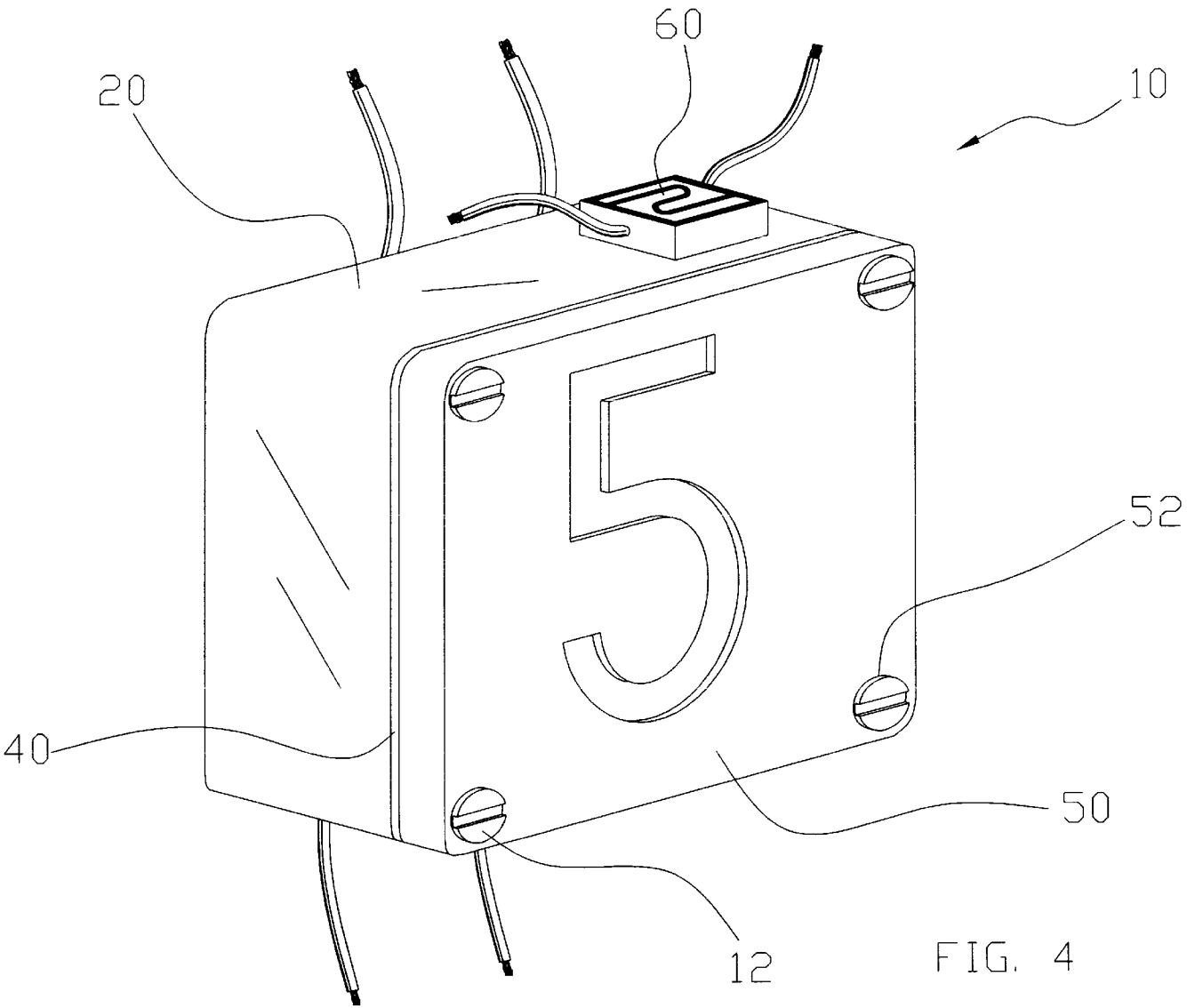
FIG. 4 is an upper perspective view of the present invention.
Figure 5:
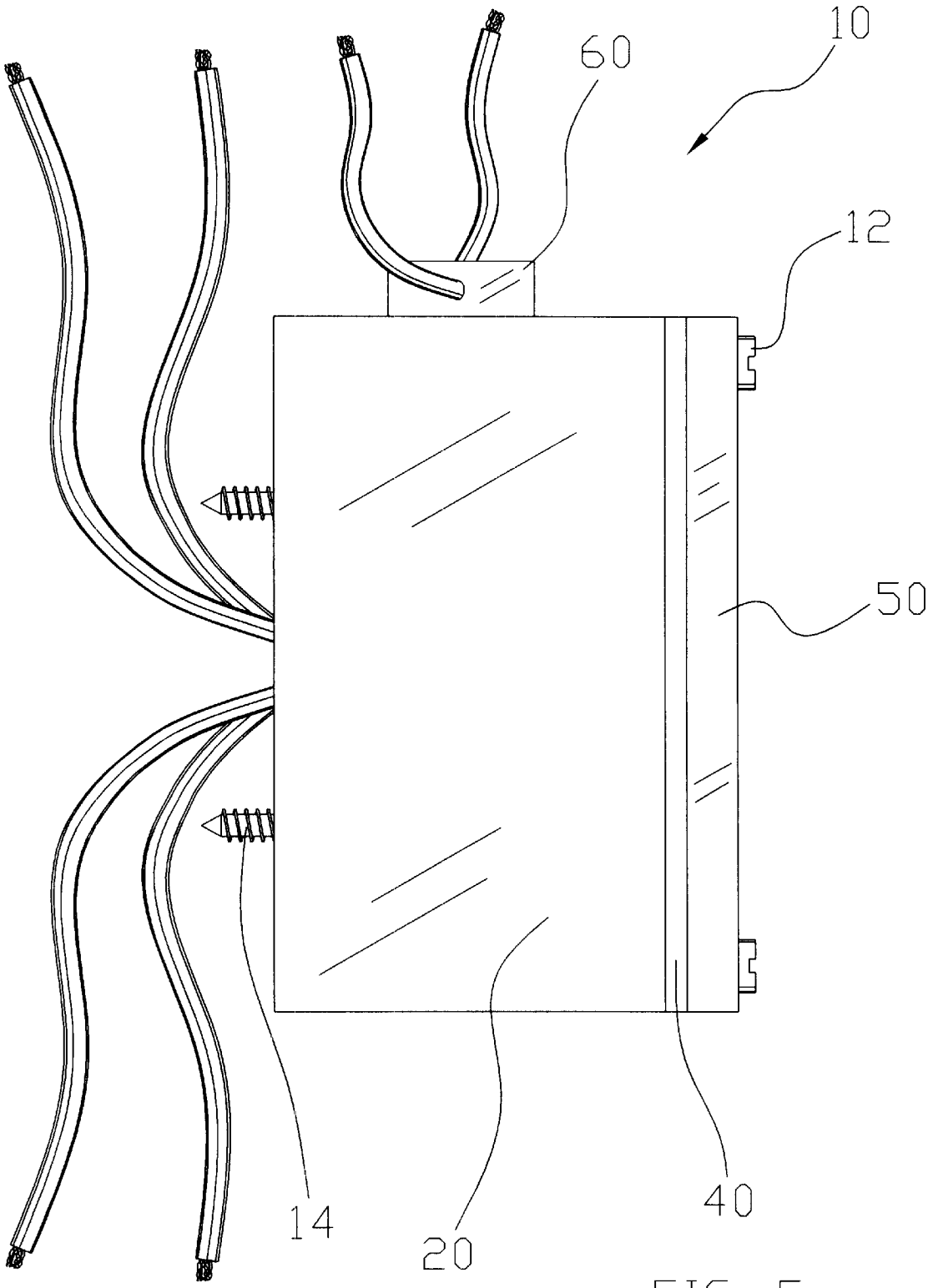
FIG. 5 is a side view of the present invention.
Figure 6:
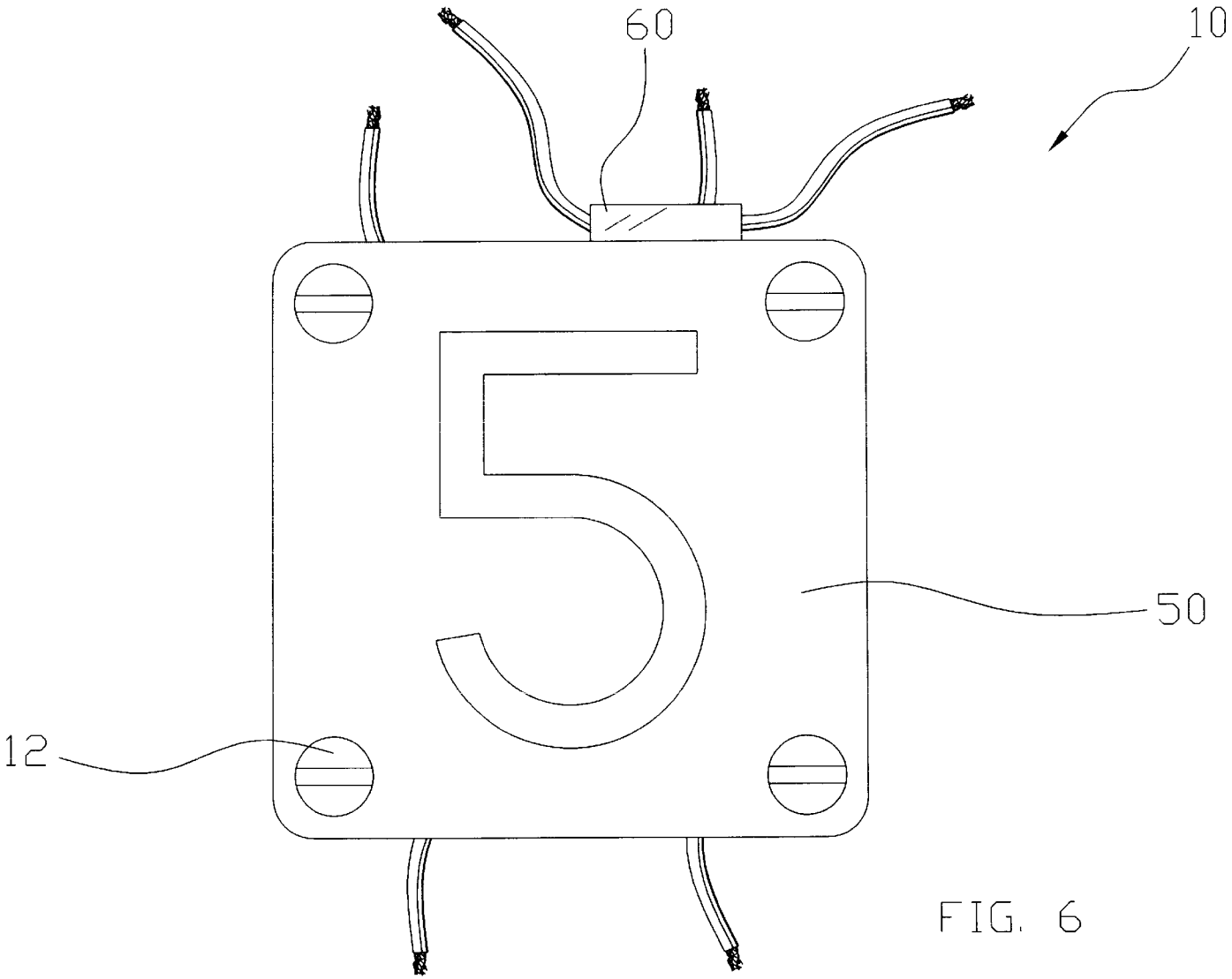
FIG. 6 is a front view of the present invention.

As shown in FIGS. 1, 2 and 5 of the drawings, wires electrically connected to the light bulbs 70 extend through the rear light apertures 24. The light bulbs 70 within the housing unit 20 are preferably positioned within front light apertures 32 of a reflective plate 30.

The identifying plate 40 is comprised of transparent, semi-transparent or opaque material. The identifying plate 40 includes a plurality of first receiver apertures 42 that receive the first fasteners 12 as shown in FIG. 1 of the drawings. The identifying plate 40 includes one or more indicia comprised of characters such as but not limited to letters and numbers. The indicia may be formed within the identifying plate 40 using coloring, paint, etching or by cutting out the indicia within the identifying plate 40.

A cover plate 50 having a plurality of second receiver apertures 52 is preferably attached about the identifying plate 40. The cover plate 50 is preferably transparent or semi-transparent, and may be tinted or colored.

As shown in FIGS. 1 through 6 of the drawings, the photocell switch unit 60 is electrically connected between the power source and the light bulbs 70 for applying or removing electrical power to the light bulbs 70. The photocell switch unit 60 closes the electrical circuit when light conditions are reduced to a certain level. The photocell switch unit 60 opens the electrical circuit when light conditions are increased to a certain level thereby reducing electrical power consumption during daylight hours. When a plurality of housing units 20 are attached to one another using conventional fasteners or other fastening devices, the plurality of light bulbs 70 are connected in series or in parallel to one another with a common ground wire.

Figure 7:
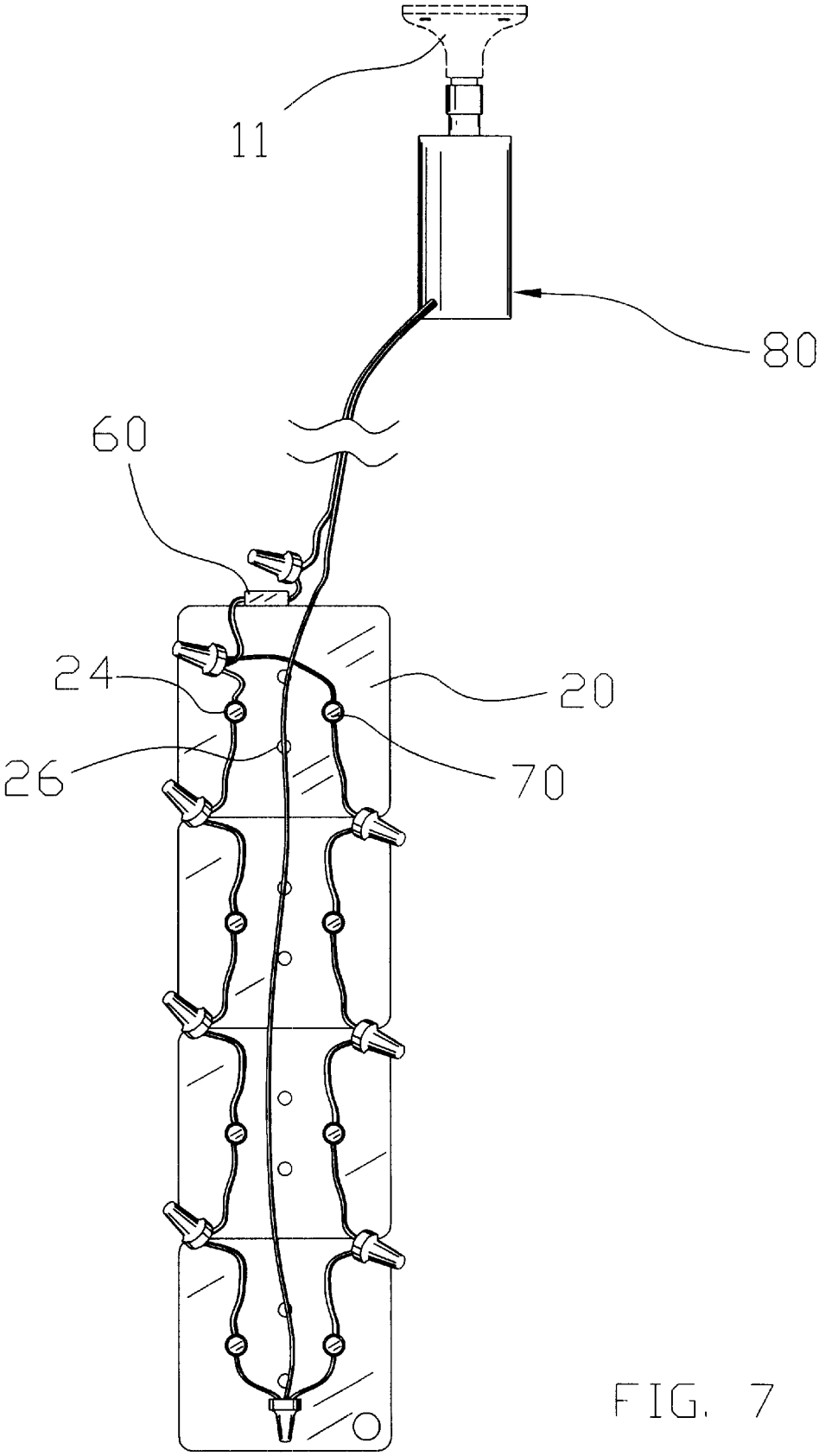
FIG. 7 is a rear view of the present invention electrically connected to a socket transformer.
Figure 8:
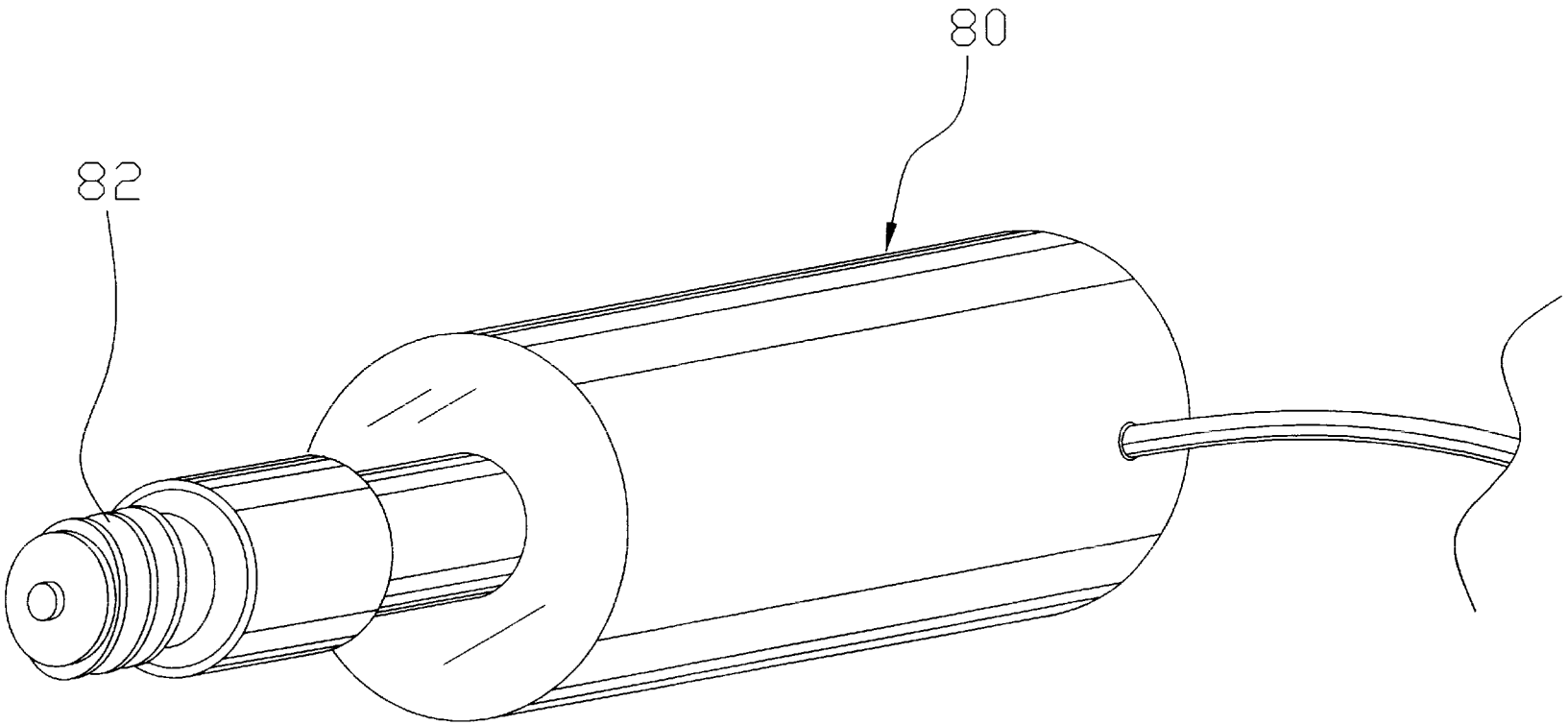
FIG. 8 is an upper perspective view of the socket transformer.
Figure 9:
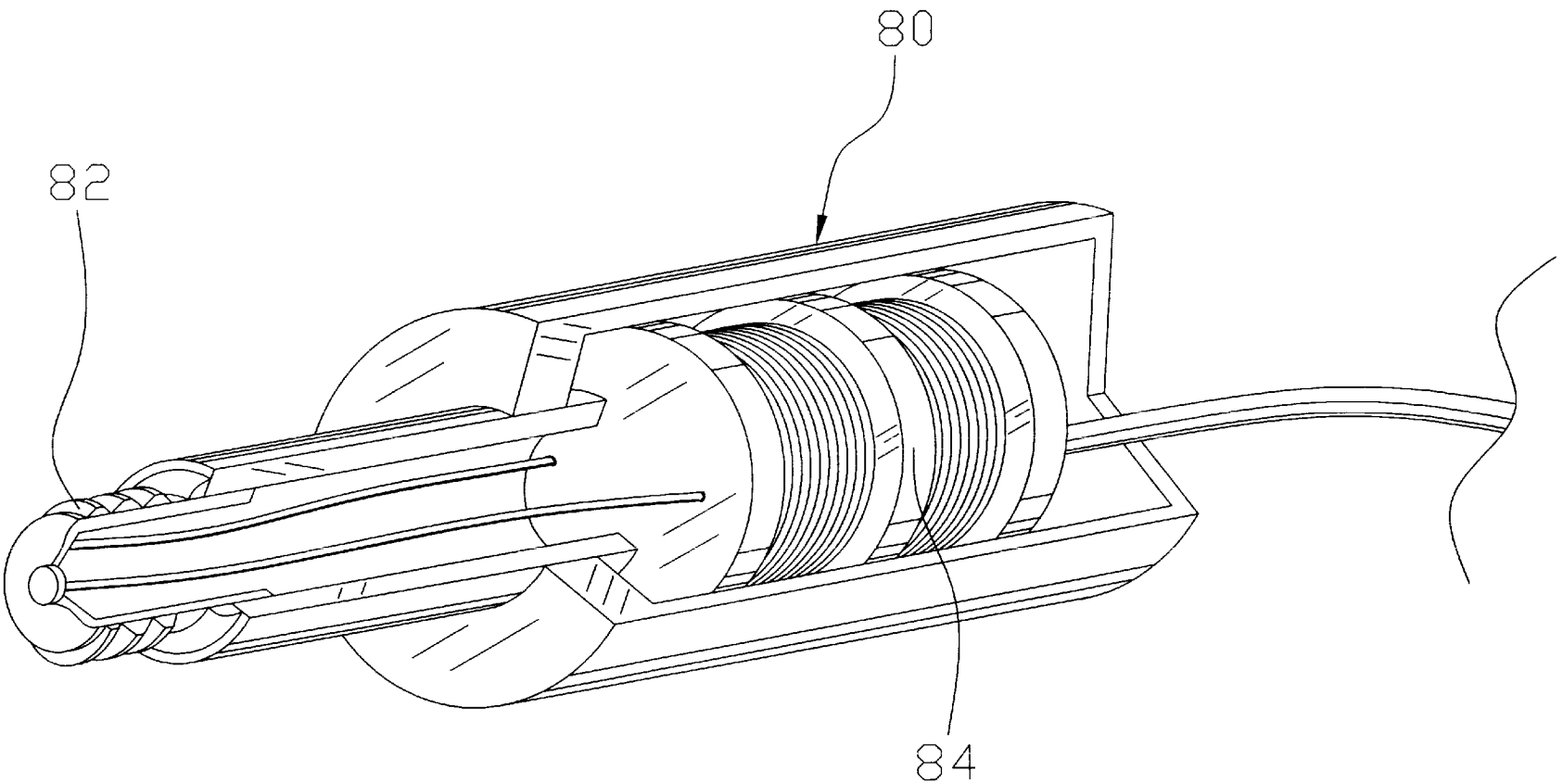
FIG. 9 is a cutaway upper perspective view of the socket transformer.
Figure 10:
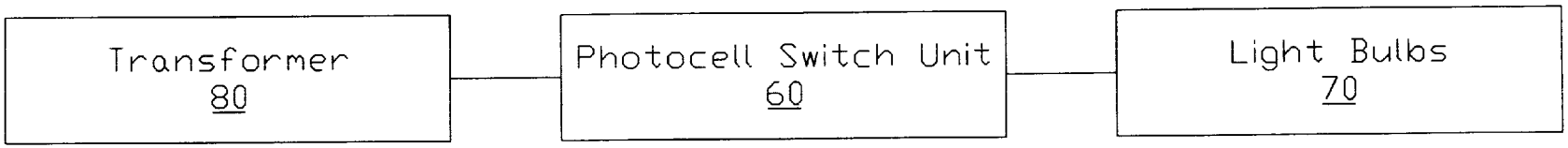
FIG. 10 is a block diagram of the electrical components of the present invention.

FIGS. 7 through 9 illustrate a socket transformer 80 that is electrically connected to a conventional light socket 11. The socket transformer 80 has a threaded end 82 that is threadably connectable to the light socket 11. A transformer unit 84 within the socket transformer 80 either steps up or steps down the voltage received from the light socket 11. The transformer unit 84 may also convert the AC voltage from the light socket to DC voltage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An illuminated identification system, comprising:

a housing unit having an interior cavity and a front opening;

a light bulb positioned within said housing unit;

a photocell switch unit electrically connected to said light bulb for controlling electrical power to said light bulb;

a socket transformer having a threaded end and a transformer unit electrically connected to said photocell switch unit;

an identifying plate attached to said front opening, wherein said identifying plate includes an indicia; and a cover plate attached to said identifying plate.

2. The illuminated identification system of claim 1, wherein said cover plate is transparent.

3. The illuminated identification system of claim 1, wherein said cover plate is semi-transparent.

4. The illuminated identification system of claim 1, including a reflective plate positioned within said housing unit.

5. The illuminated identification system of claim 4, wherein said reflective plate includes a front light aperture for receiving said light bulb.

6. The illuminated identification system of claim 1, wherein said indicia within said identifying plate are formed by one or more slots.

7. The illuminated identification system of claim 1, wherein said indicia within said identifying plate are formed by coloring.

8. The illuminated identification system of claim 1, wherein said housing unit includes at least one rear mounting aperture for mounting said housing unit with conventional fasteners.

9. The illuminated identification system of claim 1, wherein said housing unit has a square shape.

10. The illuminated identification system of claim 1, wherein said cover plate and said identifying plate are attached to a said housing unit by a plurality of fasteners threadably connected to a plurality of threaded apertures within said housing unit.

* * * * *